US006851407B2

(12) United States Patent
Zimmermann et al.

(10) Patent No.: US 6,851,407 B2
(45) Date of Patent: Feb. 8, 2005

(54) CONNECTING PIECE

(75) Inventors: Helmut Zimmermann, Hösslinswart (DE); Michael Joos, Fellbach (DE); Andreas Radtke, Bad Cannstatt (DE); Stefan Leuze, Remshalden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 35 days.

(21) Appl. No.: 10/396,420

(22) Filed: Mar. 26, 2003

(65) Prior Publication Data

US 2003/0217740 A1 Nov. 27, 2003

(30) Foreign Application Priority Data

Mar. 26, 2002 (DE) ..... 102 13 414

(51) Int. Cl.[7] ..... F02M 35/10
(52) U.S. Cl. ..... 123/184.21; 123/590
(58) Field of Search ..... 123/184.21, 184.61, 123/590

(56) References Cited

U.S. PATENT DOCUMENTS 4,711,225 A * 12/1987 Holderle et al. ..... 123/590
5,065,708 A * 11/1991 Wehle et al. ..... 123/73 C
6,073,609 A * 6/2000 Buswell et al. ..... 123/306

* cited by examiner

*Primary Examiner*—Andrew M. Dolinar
*Assistant Examiner*—Katrina Harris
(74) *Attorney, Agent, or Firm*—Walter Ottesen

(57) ABSTRACT

A connecting piece (1) is disposed between a carburetor (4) and an inlet channel (3) in an internal combustion engine of a portable handheld motor-driven work apparatus. The connecting piece functions to compensate for relative position changes between the engine and the carburetor (4), is made of elastic material and includes an expansion fold (5) for compensating for changes in position. The length of the expansion fold (5) is changeable from a collapsed to an expanded length. The expansion fold (5) subdivides the connecting piece (1) into a carburetor-end channel section (6) having a circularly-shaped cross section and an engine-end channel section (7) having a cross section departing from the circular form at the end facing toward the engine. The connecting piece (1) has a constant flow cross section over its entire length when the expansion fold (5) is collapsed.

14 Claims, 4 Drawing Sheets

CONNECTING PIECE

FIELD OF THE INVENTION

The invention relates to a connecting piece between the carburetor and the combustion chamber of an internal combustion engine of a handheld portable work apparatus such as a motor-driven chain saw, cutoff machine or the like.

BACKGROUND OF THE INVENTION

An air/fuel mixture flows through the connecting piece from the carburetor to the combustion chamber during operation of the internal combustion engine. A portion of the fuel, especially long-chain hydrocarbons, deposits on the inner wall of the connecting piece and forms a fuel film. Fuel can also collect in the expansion fold of the connecting piece and this fuel can reach the intake channel in an uncontrolled manner because of movements of the work apparatus and can lead to a change of the mixture. These uncontrolled mixture changes can lead to disturbances especially in engines having a low power/weight ratio.

A connecting piece between a carburetor and the combustion chamber of a cylinder is disclosed in U.S. Pat. No. 4,711,225. This connecting piece is made of elastic material and has an expansion fold. A knurling is provided in a region of the connecting piece in order to prevent the fuel film, which has deposited on the inner wall of the connecting piece, from suddenly and uncontrollably reaching the combustion chamber. The knurling is intended to prevent the formation of an uninterrupted fuel film.

It has been shown that the collection of fuel in the connecting piece and the sudden entrainment of the fuel into the combustion chamber is also influenced by the flow velocity in the connecting piece.

SUMMARY OF THE INVENTION

It is an object of the invention to provide a connecting piece which prevents an enrichment of the mixture because of fuel stored in the connecting piece.

The elastic connecting piece of the invention is for connecting a carburetor to an inlet channel of an internal combustion engine of a portable handheld motor-driven work apparatus. The connecting piece includes: an annular conduit-like member defining a longitudinal direction; the annular conduit-like member having an expansion fold for compensating for relative position changes between the carburetor and the engine; the expansion fold being changed between a collapsed length (a) whereat the expansion fold is collapsed and an expanded length (b) whereat the expansion fold is open; the expansion fold subdividing the conduit-like member into a carburetor-end section and an engine-end section; the carburetor-end section having a circular flow cross section and the engine-end section having an end facing toward the engine; the engine-end section having a flow cross section at the end which departs from a circularly-shaped flow cross section; and, the connecting piece having an essentially constant flow cross section over the entire length thereof when the expansion fold is at the collapsed length (a).

The essentially constant flow cross section of the connecting piece over the total length leads to a substantially constant flow velocity in the connecting piece. The flow cross section lies perpendicularly to the flow direction of a medium flowing through the connecting piece. The connecting piece has a seal lip and a seal seat in the region of the expansion fold. The seal lip lies substantially in fluid tight contact engagement with the seal seat when the expansion fold is pushed together or collapsed. The expansion fold does not influence the free flow cross section in the connecting piece when the expansion fold is closed by the seal lip. It is advantageous when the seal lip and seal seat run mutually parallel in a region so that the expansion fold is still closed when there are slight changes in length. With this configuration, a collection of fuel in the expansion fold can be prevented.

It is practical that the width of the connecting area of the connecting piece to the inlet channel measured in the cylinder peripheral direction is greater than the height of the connecting area. The connecting area especially has the form of an ellipse flattened at its upper side. Especially for slot-controlled two-stroke engines, a wide low form of the inlet channel into the internal combustion engine is advantageous in order to realize a large inlet cross section for short control times. Especially with the manufacture of the cylinder in the pressure casting process with sliders, a corresponding form of the connecting area results because of the slightly conical side walls in the inlet channel. An approximately elliptical cross-sectional form has been shown to be advantageous for the connecting area.

The elliptical connecting area is not generated by a transition, which changes over the entire cross-sectional form, from the circular form to the elliptical form; instead, the transition is achieved by a substantially one-sided curved or arched portion of the upper channel region facing toward the cylinder head. In this way, it is avoided that fuel collects in the lower region of the connecting piece because of a slope which is too small.

The longitudinal center axis of the carburetor-end channel section is inclined relative to the connecting area of the connecting piece at the inlet channel by an inclination angle $\alpha$ of less than 90° (especially approximately 75°) to the cylinder head. In this way, and for a perpendicular cylinder axis for the lower channel section, an inclination of the channel base of approximately 15° relative to the horizontal results which has been shown to be practical for conducting away fuel. The position of the carburetor relative to the engine permits a compact structural shape notwithstanding the upwardly offset elevation position. To ensure a sufficient stability of the connecting piece, a seal collar is mounted at the engine-side end of the connecting piece. A thickening is provided at the transition from the seal collar to the engine-end channel section at an upper channel region of the connecting piece facing toward the cylinder head. The connecting piece is not in danger of snapping or bending inwardly especially in this transition region notwithstanding the flat cross section and the inclined built-in position.

It is practical to apply knurling to the inner surface of the connecting piece for storing fuel in the carburetor-end channel section. With this knurling, fuel can be intermediately stored in the connecting piece and be outputted slowly to the mixture flow. Grooves advantageously run in the longitudinal direction of the connecting piece on the inner contour thereof. These grooves run approximately over the entire length of a channel section of the connecting piece, especially, over the entire length thereof. The grooves improve the removal of fuel, which deposits on the inner walls of the connecting piece, and avoid the formation of large fuel droplets on the inner wall of the connecting piece.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
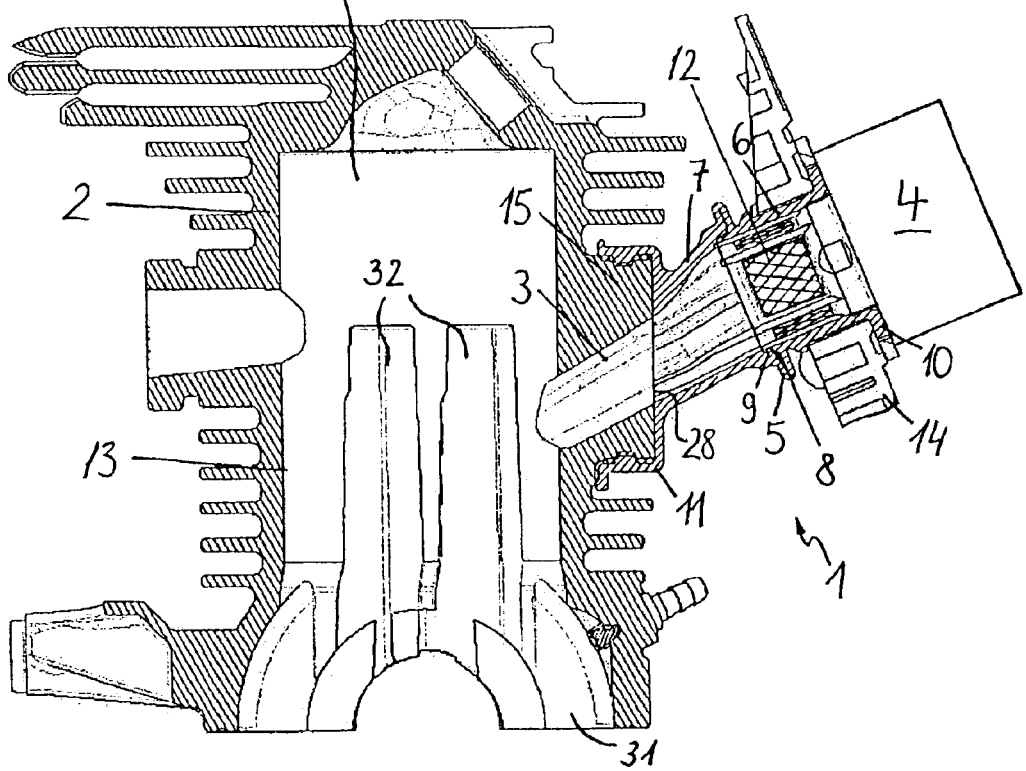
FIG. 1 is a side elevation view, in section, of a cylinder of a two-stroke engine with a connecting piece mounted on the intake stub with the connecting piece shown in the collapsed or pressed state.

FIG. 1 shows the cylinder 2 of an internal combustion engine which can be configured as a two-stroke engine. An inlet channel 3 opens into the cylinder bore 13. The inlet channel 3 conducts an air/fuel mixture to the combustion chamber 33 via the crankcase 31 and the overflow channels 32. The air/fuel mixture is prepared in the schematically-illustrated carburetor 4 and is supplied to the inlet channel via the connecting piece 1. The carburetor 4 is fixed to a housing part 14 and the engine is movably mounted relative to this housing part. The connecting piece 1 is made of elastic material and functions to compensate for relative position changes between the carburetor 4 and the cylinder 2 of the engine. For this purpose, the connecting piece 1 includes an expansion fold 5 whose length is variable from the collapsed or pushed-together length (a) shown in FIG. 2 up to the expanded length (b) shown in FIG. 3.

Figure 5:
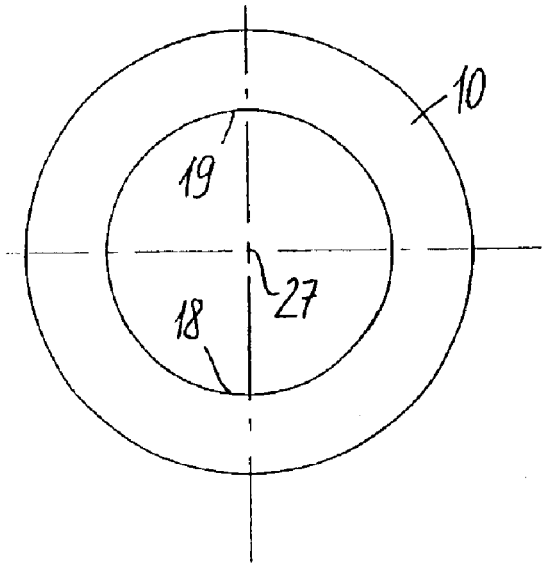
FIG. 5 is an elevation end view of the connecting piece viewed in the direction of arrow V of FIG. 2; and, FIG. 6 is an elevation end view of the connecting piece viewed in the direction of arrow VI in FIG. 2.
Figure 6:
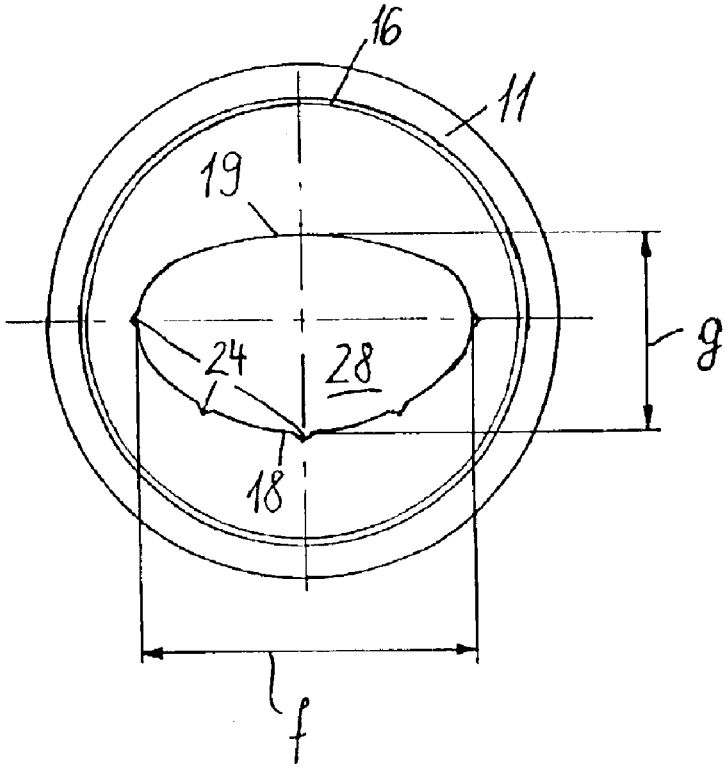

The expansion fold 5 subdivides the connecting piece 1 into a carburetor-end channel section 6 and into an engine-end channel section 7. The carburetor-end channel section 6 includes a circularly-shaped flow cross section as shown in FIG. 5; whereas, in the engine-end channel section 7, the cross-sectional form changes from the circular form at the expansion fold 5 to an almost elliptical form at the connecting area 28 between the connecting piece 1 and the inlet channel 3 of the engine. A view toward the connecting area 28 of the connecting piece 1 is shown in FIG. 6. The connecting area 28 has a larger radius in the upper channel region 19 than in the base region 18. The width (f) of the connecting area 28 is greater than its height (g).

Figure 2:
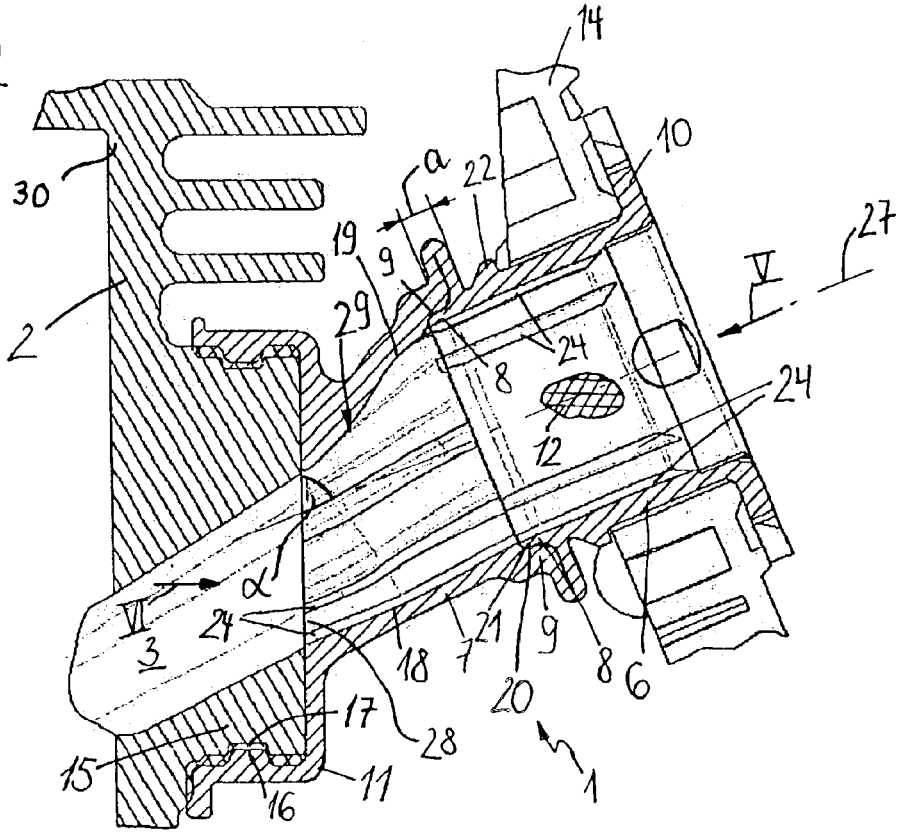
FIG. 2 is an expanded view, in section, of the connecting piece of FIG. 1.
Figure 3:
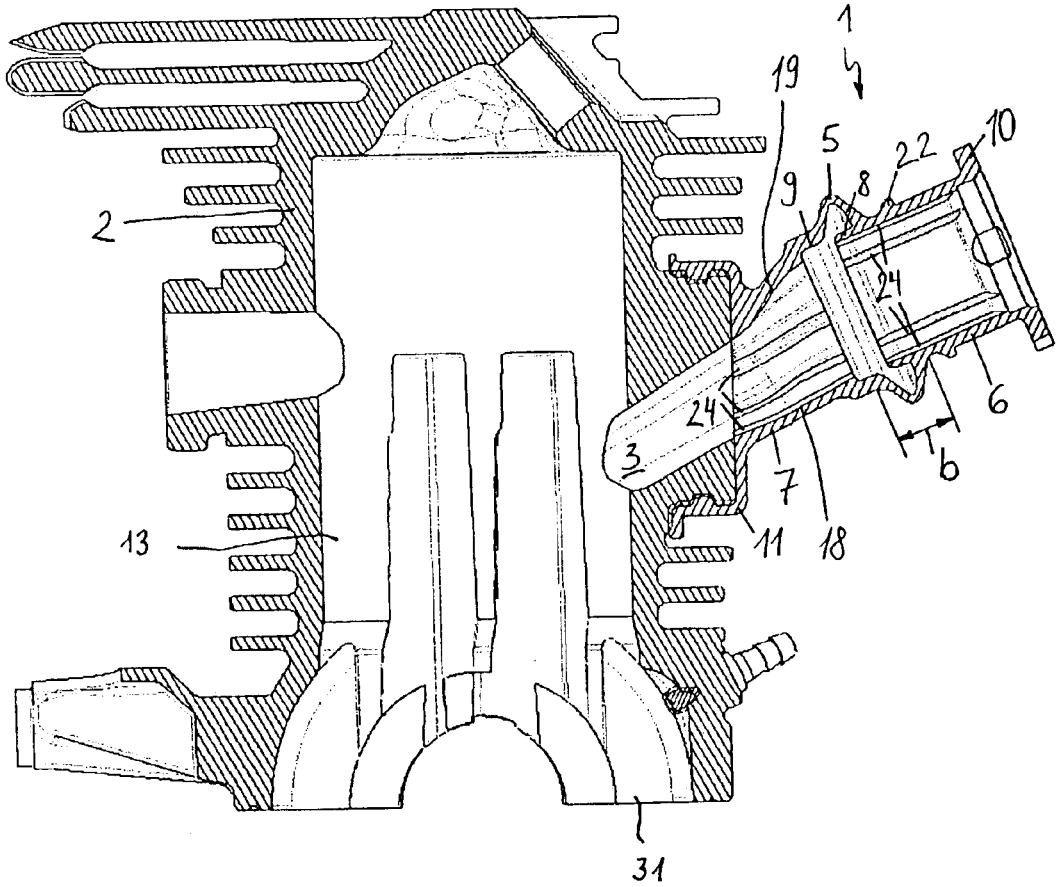
FIG. 3 is a section view of a cylinder of a two-stroke engine having a connecting piece mounted on the intake stub with the connecting piece having an expansion fold shown in the expanded state.

The base region 18 of the connecting piece 1 shown in FIG. 2 runs over the entire length of the connecting piece 1 approximately in a straight line and approximately parallel to the longitudinal center axis 27 of the carburetor-end channel section 6. The change of the cross-sectional form is formed by a curved or arched portion 29 of the upper channel region 19, which faces toward the cylinder head, in the interior of the connecting piece. The flow cross section in the interior of the connecting piece is essentially the same over the entire length of the connecting piece and is advantageously constant. All cross sections, which run perpendicular to the flow direction, therefore have substantially the same area content.

The expansion fold 5 is configured, in cross section, as a V-shaped bead directed outwardly. The connecting piece 1 includes a seal lip 8 which is disposed on the carburetor-end channel section 6 and defines an extension of the carburetor-end channel section 6 in the direction toward the engine-end channel section 7.

Figure 4:
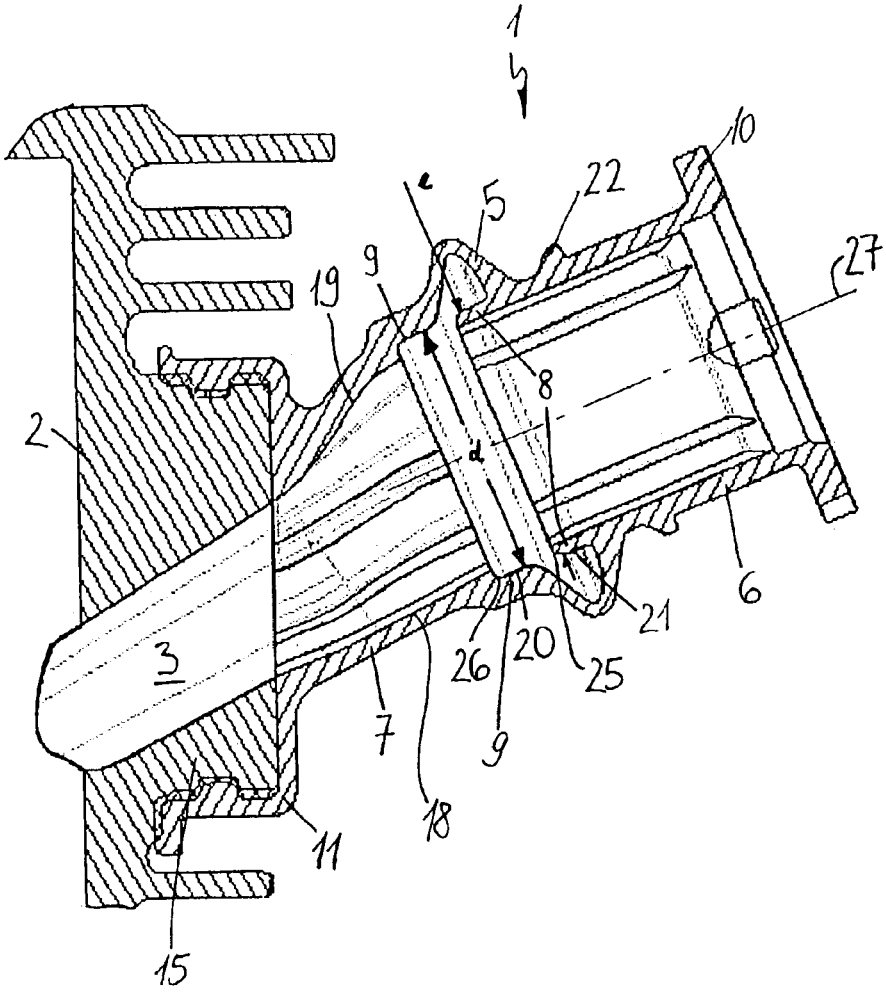
FIG. 4 shows an enlarged section view of the connecting piece of FIG. 3.

In FIG. 4, the expansion fold 5 is shown enlarged and in the expanded position. A seal seat 9 is arranged on the engine-end channel section 7 and is configured as an annularly-shaped step. The annularly-shaped seat runs parallel to the inner contour of the connecting piece 1 in a section 20 The seal lip 8 likewise includes an end section 21 configured parallel to the inner contour. The end section 21 coacts with a section 20 of the seal seat 9 and closes the expansion fold 5 seal tight when the sections 20 and 21 overlap each other (FIG. 2) in the direction of the longitudinal center axis 27. For a slightly expanded expansion fold 5, the seal seat 9 remains partially covered by the seal lip 8 so that the expansion fold 5 is closed. The outer diameter (e) of the seal lip 8 is greater than the inner diameter (d) of the seal seat 9 so that a good sealing is achieved. In order to avoid a clamping of the seal lip 8 on the seal seat 9 when collapsing the expansion fold 5, the seal lip 8 is configured to be rounded at its forward edge 25. The seal seat 9 includes a corresponding rounded portion 26 in order to make possible a complete covering of the seal seat 9 by the seal lip 8.

In the built-in state of the connecting piece 1, the expansion fold 5 is collapsed and is closed by the seal lip 8 in the seal seat 9 as shown in FIGS. 1 and 2. The seal lip 8 and the bordering engine-end channel section 7 have the same inner diameter so that no edge is formed at which fuel droplets could collect. The arrangement is so provided that fuel can flow to the engine-end channel section 7 even when the expansion fold 5 between the engine-end channel section 7 and the carburetor-end channel section 6 is slightly open.

The connecting piece 1 is fixed to the inlet channel 3 by a seal collar 11 which engages around an intake stub 15. An edge 16 is provided on the seal collar 11 as shown in FIG. 2 for fixing in axial direction of the intake stub 15. The edge 16 engages into a slot 17 arranged on the inlet stub 15. The approximately elliptical connecting area 28 of the connecting piece 1 advantageously passes seamlessly into the cross-sectional area of the inlet channel 3. The seal collar 11 lies at right angles to the connecting area 28. The longitudinal center axis 27 is inclined at an angle of 75° relative to the connecting area 28 so that the base region 18, which faces toward the crankcase 31, has a slope of approximately 15°.

In order to counter a snap-in of the connecting piece 1 during intense mechanical load, a thickening 23 is provided on the upper channel region 19, which faces toward the cylinder head 30, at the transition of the engine-end channel section 7 into the seal collar 11. The connecting piece 1 is fixed between the housing part 14 and the carburetor 4 by the connecting flange 10. The flow cross section in the carburetor 4 passes seamlessly into the cross section in the connecting piece 1. An edge 22 is provided on the outer contour of the carburetor-end channel section 6 for fixing the connecting piece 1 to the housing part 14 during assembly. The edge 22 takes up axial forces occurring because of the collapsing or pushing together. If the connecting piece 1 is collapsed during operation starting from the built-in position, then this collapse is not compensated by the expansion fold 5 but by the elasticity of the connecting piece 1.

The carburetor-end channel section 6 includes knurling 12 on its inner surface. The knurling 12 can be applied also to the engine-end channel section 7. The manufacture is, however, more complex because of the elliptical shape.

Grooves 24 are arranged in the longitudinal direction of the connecting piece 1. The grooves 24 can extend over the entire length of the connecting piece 1. However, it can be advantageous that the grooves 24 extend only over channel sections (6, 7) and/or over a part region of the channel sections (6, 7). In the base region 18 as well as on both sides thereof, grooves 24 are arranged which extend from just under the connecting flange 1 up to the inlet channel 3 of the cylinder 2; whereas, the grooves 24, which are arranged laterally and in the upper channel region 19, extend only over the length of approximately one channel section (6, 7).

It is understood that the foregoing description is that of the preferred embodiments of the invention and that various changes and modifications may be made thereto without departing from the spirit and scope of the invention as defined in the appended claims.

What is claimed is:

1. An elastic connecting piece for connecting a carburetor to an inlet channel of an internal combustion engine of a portable handheld motor-driven work apparatus, said connecting piece comprising:

an annular conduit-like member defining a longitudinal direction;

said annular conduit-like member having an expansion fold for compensating for relative position changes between said carburetor and said engine;

said expansion fold being changed between a collapsed length (a) whereat said expansion fold is collapsed and an expanded length (b) whereat said expansion fold is open;

said expansion fold subdividing said conduit-like member into a carburetor-end section and an engine-end section;

said carburetor-end section having a circular flow cross section and said engine-end section having an end facing toward said engine;

said engine-end section having a flow cross section at said end which departs from a circularly-shaped flow cross section; and, said connecting piece having an essentially constant flow cross section over the entire length thereof when said expansion fold is at said collapsed length (a).

2. The elastic connecting piece of claim 1, wherein said conduit-like member has a seal lip in the region of said expansion fold and a seal seat and said seal lip is in contact engagement with said seal seat so as to substantially close the seal fluid tight when said expansion fold is collapsed.

3. The elastic connecting piece of claim 1, wherein said engine has a cylinder defining a cylinder axis and said inlet channel formed in said cylinder; said connecting piece and said inlet channel conjointly define an interface; said annular conduit-like member has a connecting area at said interface for permitting said connecting piece to communicate with said inlet channel; and, said connecting area has a height (g) measured in the direction of said cylinder axis and a width (f) measured in the peripheral direction of said cylinder which is greater than said height (g).

4. The elastic connecting piece of claim 3, wherein said connecting area has the form of an ellipse flattened on the upper side thereof.

5. The elastic connecting piece of claim 1, wherein said conduit-like member has a lower region which defines a straight-line course when said connecting piece is built into said work apparatus.

6. The elastic connecting piece of claim 5, wherein said carburetor-end section defines an axis of symmetry; and, said lower region runs approximately parallel to said axis in said carburetor-end section.

7. The elastic connecting piece of claim 2, wherein said seal lip has end portion extending parallel to the inner contour of said annular conduit-like member; said seal seat has an inner diameter (d); and, said end portion of said seal lip has an outer diameter (e) at least as large as said inner diameter (d).

8. The elastic connecting piece of claim 3, wherein said cylinder has a cylinder head; and, said carburetor-end section has a longitudinal center axis which lies inclined at an angle ($\alpha$) of less than 90° to said connecting area with said angle ($\alpha$) opening to said cylinder head.

9. The elastic connecting piece of claim 8, wherein said angle ($\alpha$) is approximately 75°.

10. The elastic connecting piece of claim 1, wherein said engine has a cylinder and a cylinder head; said annular conduit-like member has a seal collar formed on said engine-end section on the end thereof facing toward said engine; and, said annular conduit-like member having an upper region facing toward said cylinder head and having a thickening at said upper region in the transition region from said engine-end section to said seal collar.

11. The elastic connecting piece of claim 1, wherein said annular conduit-like member has an interior wall surface; and, a knurled region is applied to said interior wall surface in said carburetor-end section.

12. The elastic connecting piece of claim 1, wherein said annular conduit-like member has an interior wall surface and a plurality of grooves formed in said interior wall surface running in said longitudinal direction.

13. The elastic connecting piece of claim 12, wherein said grooves extend over the entire length of each of said carburetor-end section and said engine-end section.

14. The elastic connecting piece of claim 12, wherein said grooves extend over the entire length of said annular conduit-like member.

* * * * *